US006774878B2

(12) United States Patent
Yoshida et al.

(10) Patent No.: US 6,774,878 B2
(45) Date of Patent: Aug. 10, 2004

(54) DRIVE UNIT FOR A LUMINESCENCE DISPLAY PANEL

(75) Inventors: Takayoshi Yoshida, Yonezawa (JP); Masaki Murakata, Yonezawa (JP)

(73) Assignee: Tohoku Pioneer Corporation, Tendo (JP)

( * ) Notice: Subject to any disclaimer, the term of this patent is extended or adjusted under 35 U.S.C. 154(b) by 146 days.

(21) Appl. No.: 10/238,850

(22) Filed: Sep. 11, 2002

(65) Prior Publication Data

US 2003/0052842 A1 Mar. 20, 2003

(30) Foreign Application Priority Data

Sep. 18, 2001 (JP) ..... 2001-282660

(51) Int. Cl.[7] ..... G09G 3/30

(52) U.S. Cl. ..... 345/76; 345/45; 345/77; 315/159.1; 315/169.3

(58) Field of Search ..... 345/45, 46, 76, 345/77; 315/169.1, 169.3, 169.4; 358/505

(56) References Cited

U.S. PATENT DOCUMENTS 5,838,289 A * 11/1998 Saito et al. ..... 345/79
5,844,368 A * 12/1998 Okuda et al. ..... 315/169.3
6,351,076 B1 * 2/2002 Yoshida et al. ..... 315/169.1
6,369,515 B1 * 4/2002 Okuda ..... 315/169.3
6,376,994 B1 * 4/2002 Ochi et al. ..... 315/169.1
6,552,703 B1 * 4/2003 Ushigusa ..... 345/77
6,707,438 B1 * 3/2004 Ishizuka et al. ..... 345/78

FOREIGN PATENT DOCUMENTS

JP 9-232074 9/1997

* cited by examiner

*Primary Examiner*—Richard Hjerpe
*Assistant Examiner*—Kimnhung Nguyen
(74) *Attorney, Agent, or Firm*—Westerman, Hattori, Daniels & Adrian, LLP

(57) ABSTRACT

In a drive unit for a luminescence display panel employing organic EL elements as light-emitting elements and capable of reducing power consumed by the display panel when a partial scan mode is selected, when the partial scan mode is selected by a scan mode switching mean, a control is performed so that the ratio of a drive period (D3), during which the light emission of the light-emitting elements is controlled, to a reset period (R1) set by a reset control means is increased as compared with a case in which the ordinary scan mode is selected. Thus, the momentary luminance of the light-emitting elements can be lowered by further reducing drive currents or drive voltages supplied to the respective light-emitting elements. Accordingly, it is possible to further reduce the power consumption of the luminescence display panel as well as to prevent the deterioration of the light-emitting elements, which contributes to extend the life of the light-emitting elements.

11 Claims, 9 Drawing Sheets

【Fig. 1】
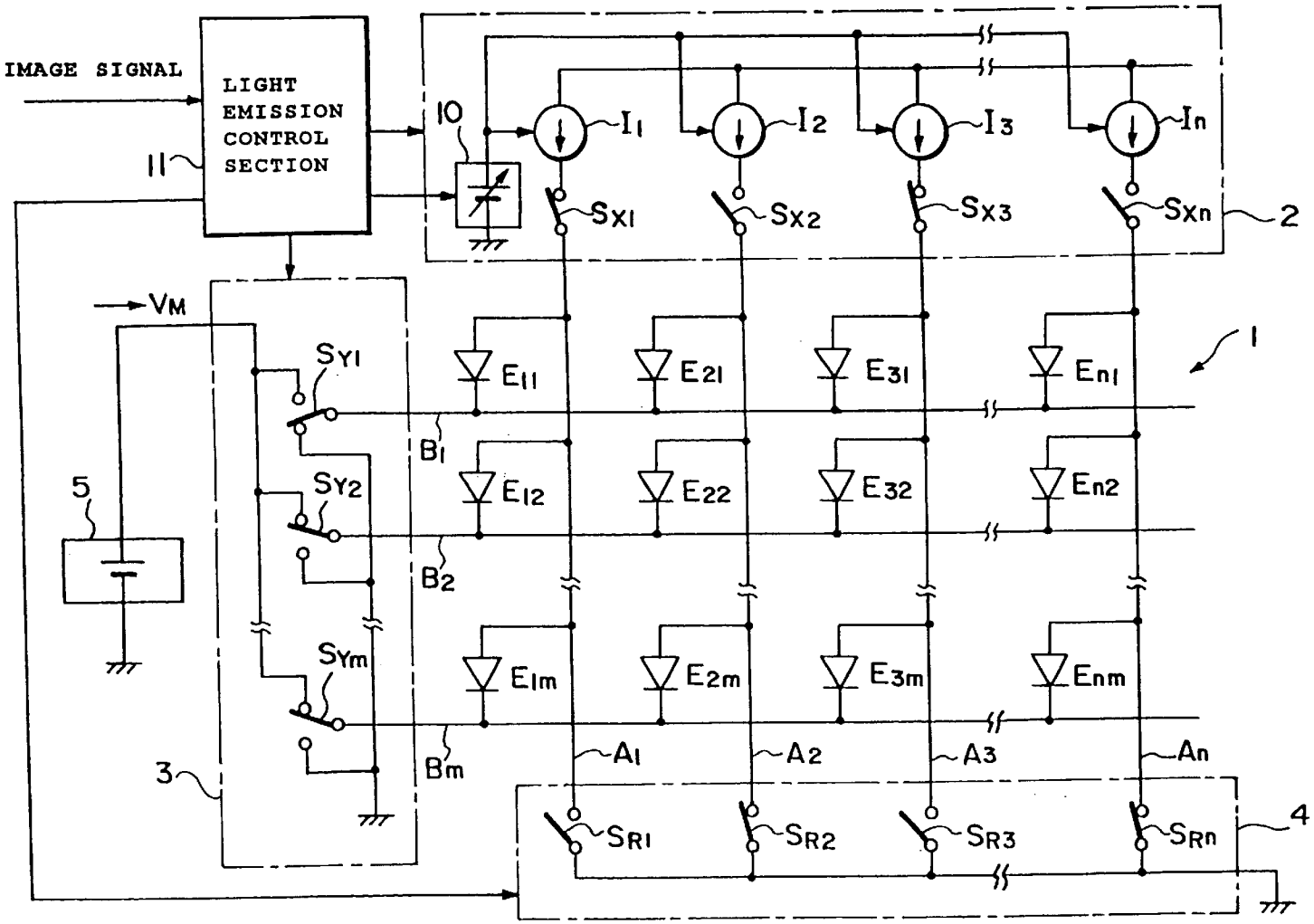

【Fig.2】
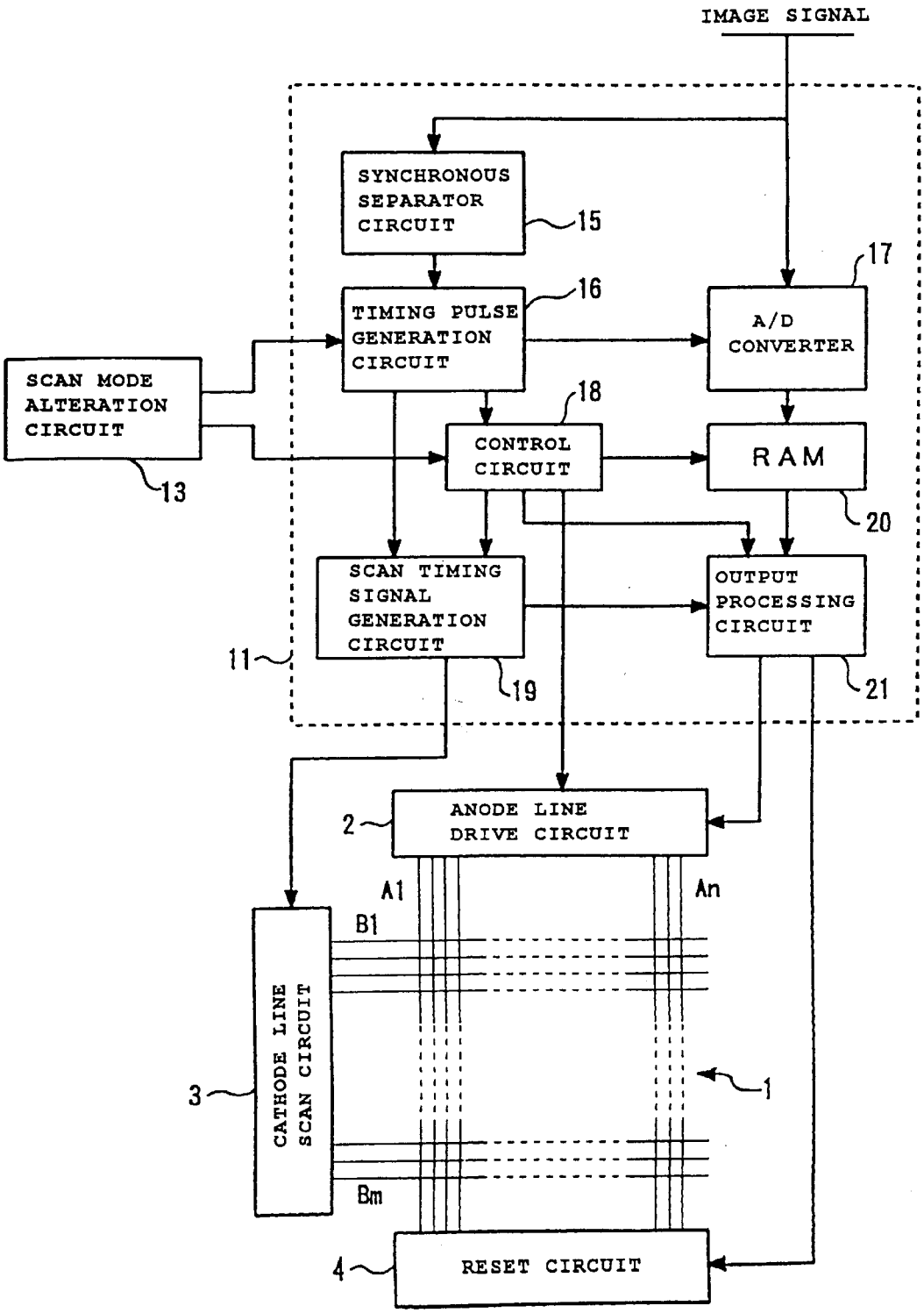

【Fig.3】
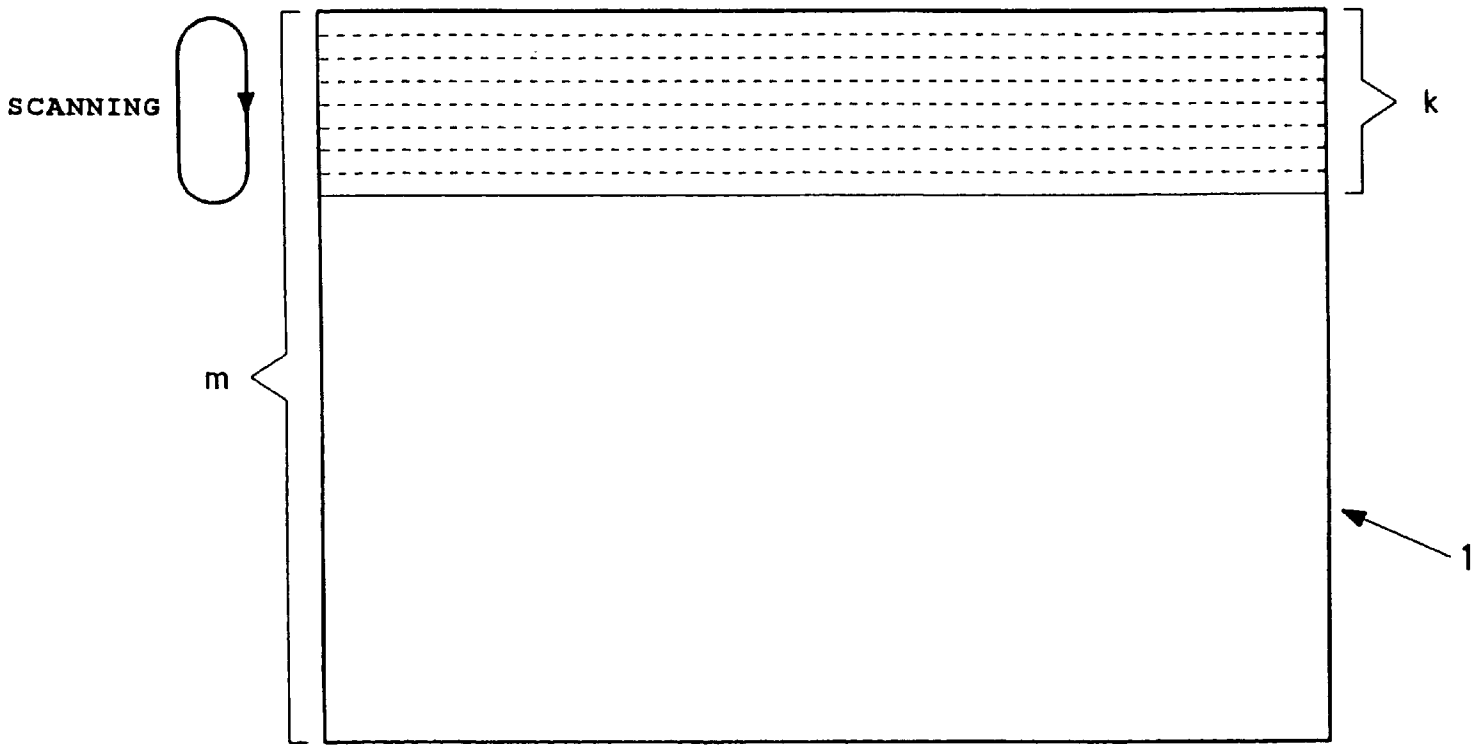

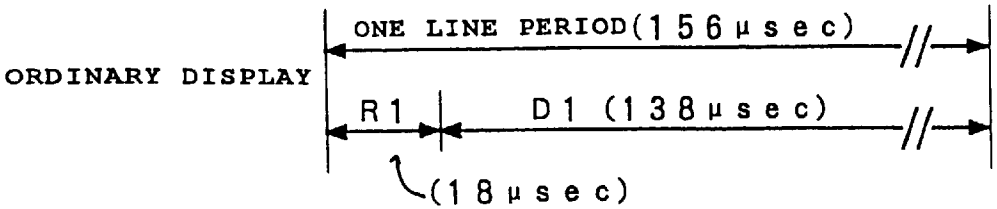
【Fig.4A】
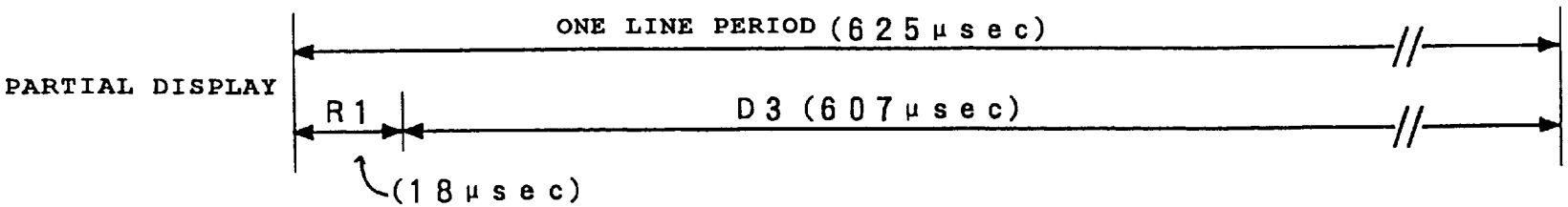
【Fig.4B】

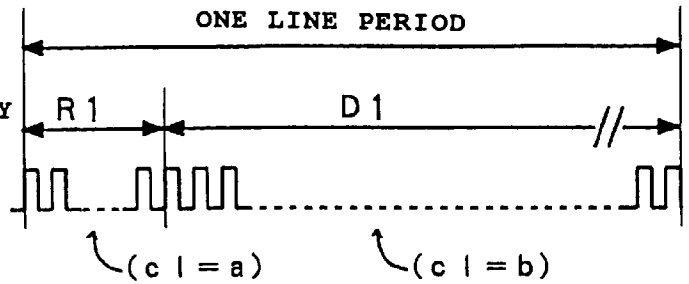
【Fig.5A】
ORDINARY DISPLAY
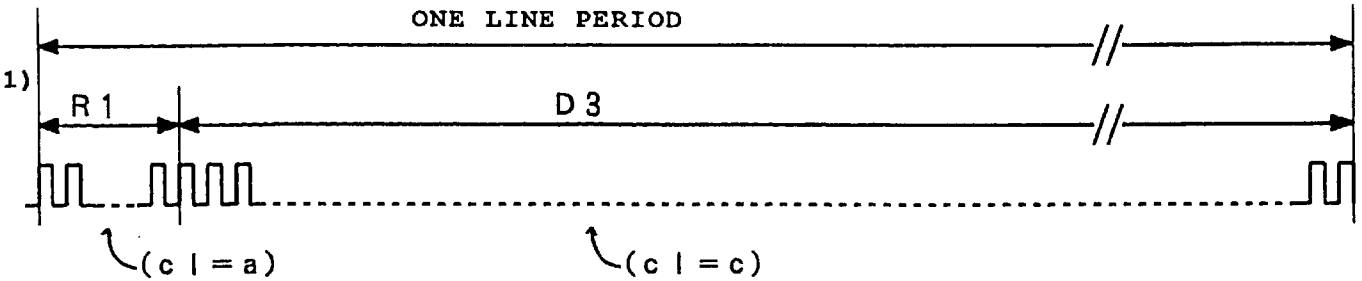
【Fig.5B】
PARTIAL DISPLAY (1)
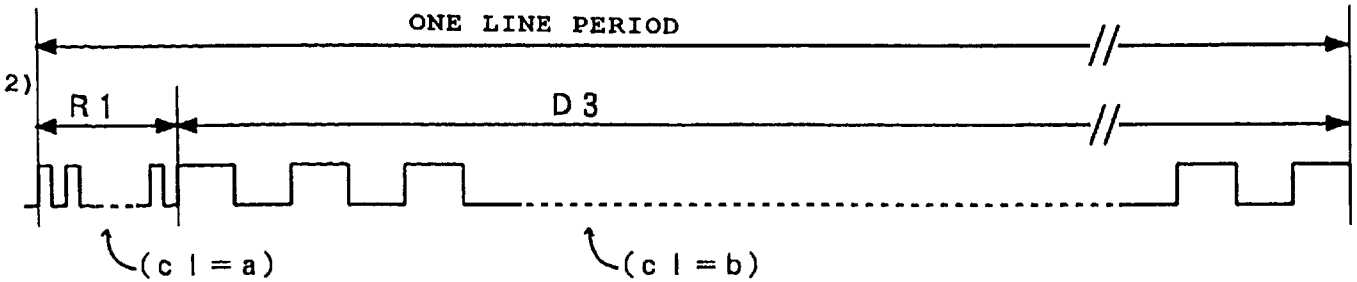
【Fig.5C】
PARTIAL DISPLAY (2)

【Fig.6】
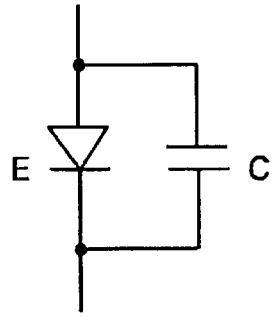
【Fig.7A】
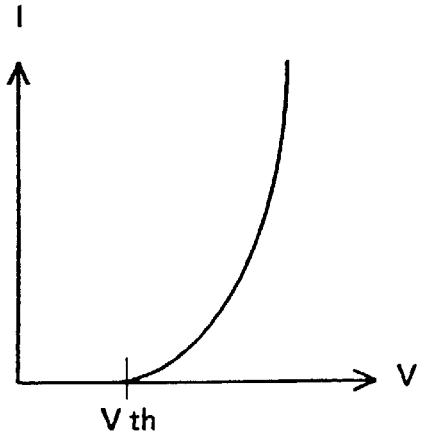
【Fig.7B】
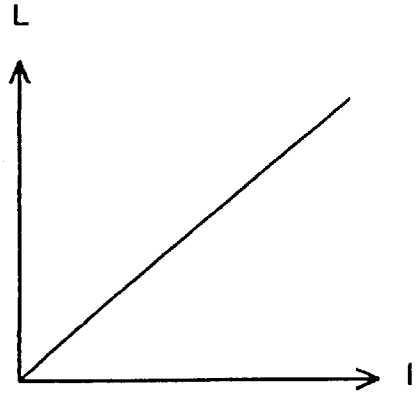
【Fig.7C】
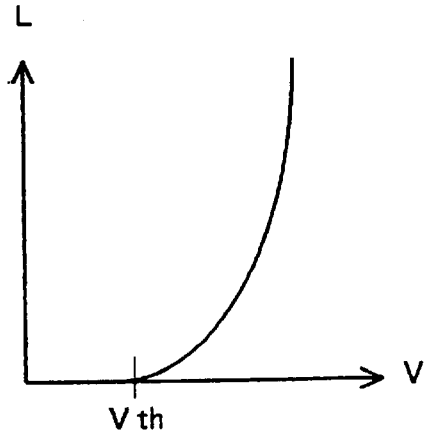

【Fig.8】
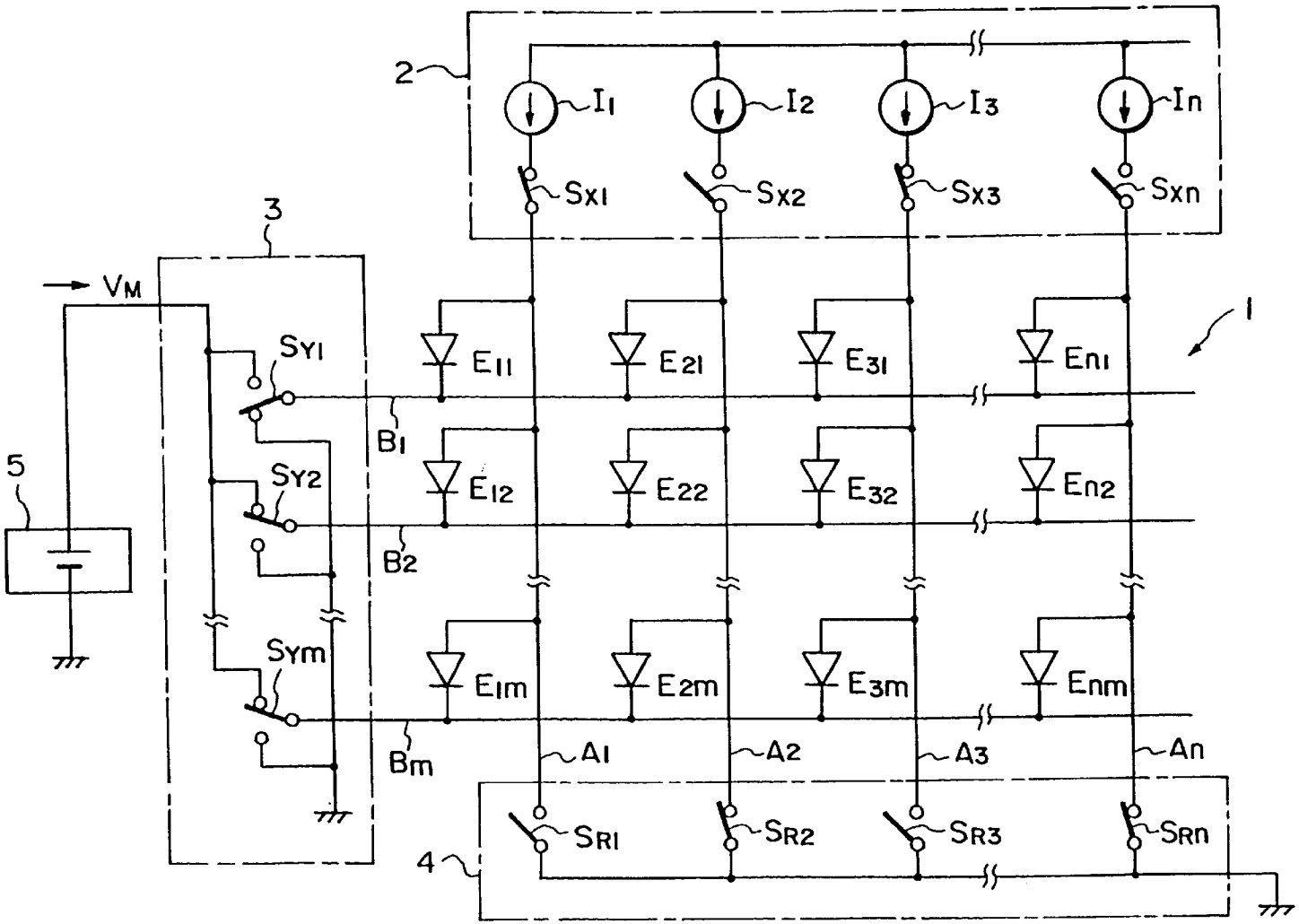

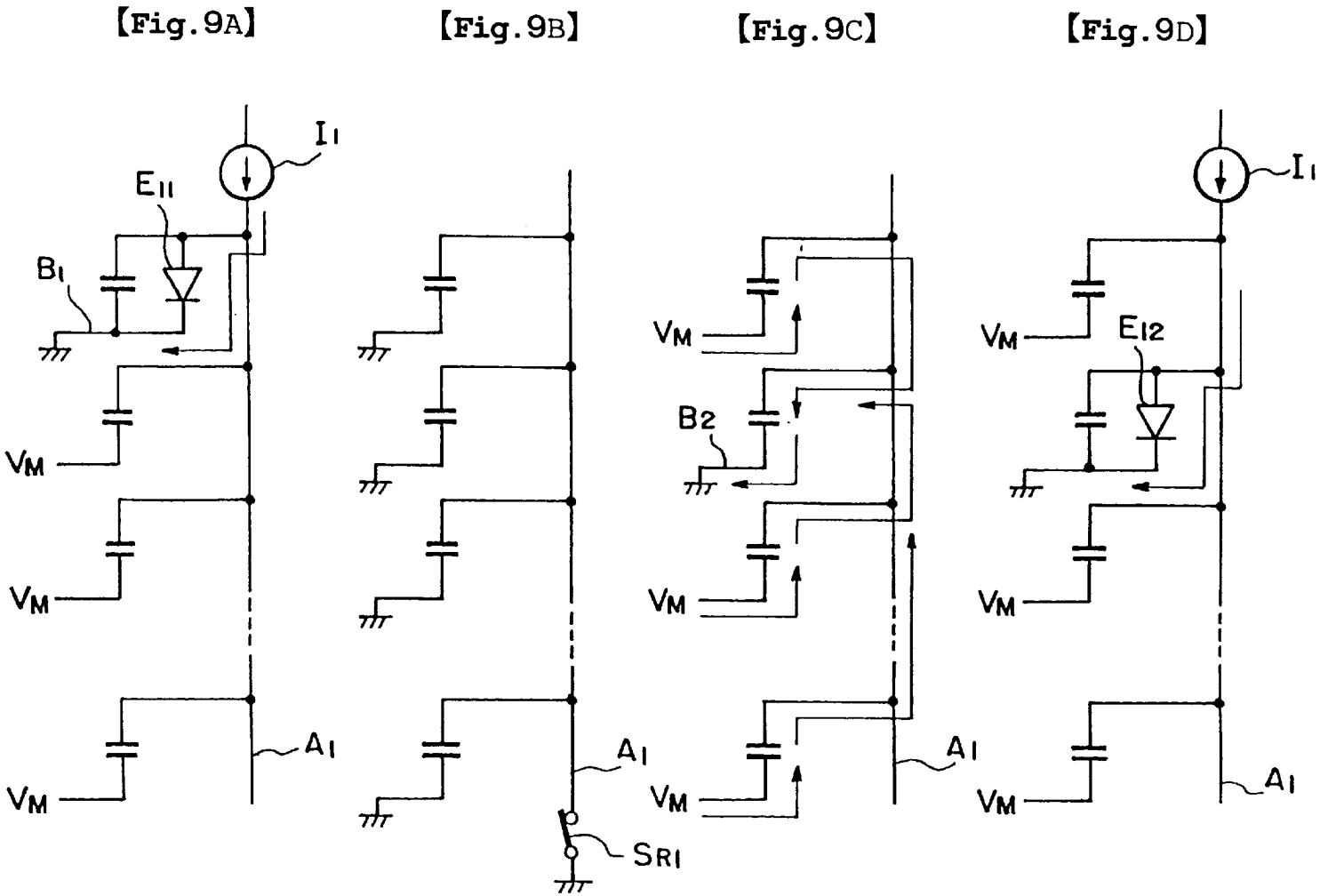
[Fig.9A]
[Fig.9B]
[Fig.9C]
[Fig.9D]
I1
E11
B1
VM
A1
SR1
B2
E12

[Fig. 10A]
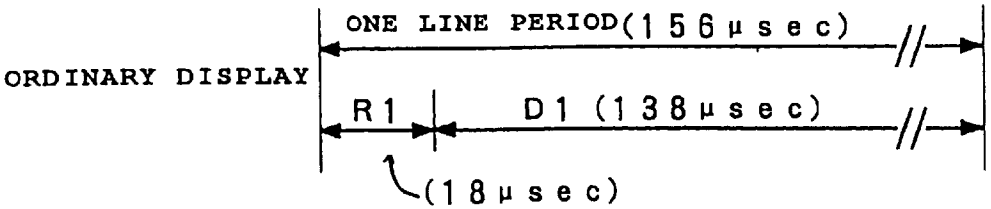
[Fig. 10B]
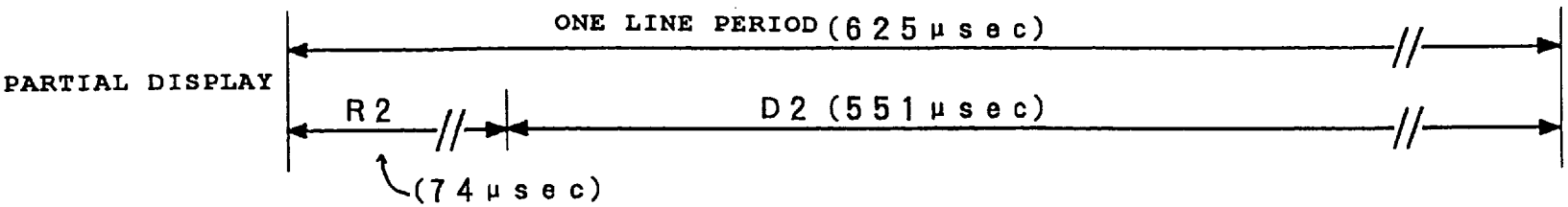

DRIVE UNIT FOR A LUMINESCENCE DISPLAY PANEL

BACKGROUND OF THE INVENTION

1. Field of the Invention

The present invention relates to a drive unit for a luminescence display panel employing, for example, organic El (electroluminescence) elements wherein the drive unit can switch between a normal scan mode in which all effective light-emitting elements in the luminescence display panel are repeatedly scanned to control light emission and a partial scan mode in which part of the effective light-emitting elements in the luminescence display panel are repeatedly scanned to control light emission, and more particularly to a drive unit for a luminescence display panel capable of achieving lower power consumption by extending the life of the light-emitting elements when the partial scan mode is selected.

2. Description of the Related Art

An organic EL display has been in practical use in some fields as a display in which a low power consumption, a high display quality, and a thin profile are possible in place of a liquid crystal display. This is because there is a background that a high efficiency and a long life by which a practical use can be endured are progressed by employing an organic compound by which an excellent light emission characteristic can be expected for a light emitting layer of EL elements employed for an EL display.

The organic EL element can be electrically expressed by an equivalent circuit as shown in FIG. 6. That is, an organic EL element can be replaced by a structure composed of a parasitic capacitance compound C and a diode compound E which is connected in parallel to the capacitance compound, and the organic External light element is deemed as a capacitive light-emitting element. In the organic EL element, when a light emission drive voltage is applied, first, electrical charge corresponding to the capacitance of the element flows into an electrode as a displacement current and is stored therein. Then, when the electrical charge exceeds a predetermined voltage (light emission threshold value=Vth) inherent in the element, current begins to flow from the electrode (anode side of the diode element E) to an organic layer constituting the light emitting layer, and it can be deemed that light is emitted at an intensity proportional to the current.

FIG. 7 shows static light emission characteristics of such organic EL element. It can be seen from the drawing that in the organic EL element, in the case where the drive voltage (V) is at a light emission threshold voltage (Vth) or greater as shown in FIG. 7A, current (I) suddenly flows to cause light emission. In other words, if the drive voltage applied is at the light emission threshold voltage or lower, after charging for the parasitic capacitance, drive current hardly flows in the EL element, and thus the element does not emit light. In a light emittable region in which the drive voltage (V) is the light emission threshold voltage or greater, the EL element has a characteristic that the EL element emits light with a luminance (L) approximately proportional to the drive current (I) as shown in FIG. 7B. Thus, an EL element has a luminance characteristic in which the greater the voltage (V) applied thereto, the greater the luminance (L) thereof in the light emittable region in which the drive voltage (V) is greater than the threshold voltage as shown in FIG. 7C.

As a driving method for a display panel constituted by arranging such plurality of organic EL elements, a passive matrix driving method is known. FIG. 8 shows an example of a passive matrix display panel and a drive unit therefor. In the passive matrix driving method, there are two driving methods for the organic EL elements, that is, cathode line scan/anode line drive and anode line scan/cathode line drive, and FIG. 8 shows a feature of the former, the cathode line scan/anode line drive. That is, "n" pieces of anode lines A1 to An are arranged as drive lines in a vertical direction, "m" pieces of cathode lines B1 to Bm are arranged as scan lines in a horizontal direction, and organic EL elements E11 to Enm are arranged at portions at which each line intersects ("n"×"m" portions in total) to construct a display panel 1.

The respective elements E11 to Enm constituting pixels are arranged in the form of a lattice, and one ends (anode terminals of the diode elements EL of the equivalent circuit described above) are connected to the anode lines and the other ends (cathode terminals of the diode elements EL of the equivalent circuit described above) are connected to the cathode lines, corresponding to intersecting positions between the anode lines A1 to An along the vertical direction and the cathode lines B1 to Bm along the horizontal direction. The anode lines are connected to an anode line drive circuit 2, and the cathode lines are connected to a cathode line scan circuit 3 so that the respective lines are driven thereby.

The cathode line scan circuit 3 is provided with scan switches SY1 to SYm corresponding to the respective cathode scan lines B1 to Bm to work so that either one of a reverse bias voltage VM from a reverse bias power supply circuit 5 (for example, 10 V) and the ground potential (0 V) is connected to a corresponding cathode scan line. The anode line drive circuit 2 is provided with drive sources I1 to In supplying drive current to the respective EL elements via the respective anode lines and drive switches SX1 to SXn, and the drive switches are controlled to be turned on so that current from the drive sources I1 to In is supplied to the respective EL elements arranged corresponding to the cathode scan lines.

Thus, the drive sources are connected to desired anode drive lines while the cathode scan lines are scanned at a predetermined cycle so that the respective light-emitting elements are selectively caused to emit light. Although voltage sources such as constant voltage circuits can be employed as the drive sources, it is general to employ constant current sources as the drive sources because of the reasons that the voltage/luminance characteristic of an EL element is unstable with respect to temperature changes, the element is deteriorated by excess current, and the like although the current/luminance characteristic of an EL element is stable with respect to temperature changes.

The respective anode drive lines are further connected to a reset circuit 4. This reset circuit 4 is provided with reset switches SR1 to SRn provided for the respective anode drive lines, and these reset switches are turned on, so that the anode drive lines are set to the ground potential. Each of the anode line drive circuit 2, the cathode line scan circuit 3, and the reset circuit 4 is driven by a command signal brought from a light emission control section which is not shown.

That is, the light emission control section controls the anode line drive circuit 2, the cathode line scan circuit 3, and the reset circuit 4 so that an image corresponding to an image signal is shown according to the image signal. In this case, control is performed wherein the cathode line scan circuit 3 sequentially selects a cathode scan line corresponding to a horizontal scan period of image data by a command from the light emission control section to set it to the ground potential, and the scan switches SY1 to SYm are switched so that other cathode scan lines are connected to the reverse bias power supply circuit 5 and the reverse bias voltage VM is applied thereto. The state shown in FIG. 8 shows a state in which the first cathode scan line B1 is scanned.

The reverse bias voltage VM is applied in order to charge the parasitic capacitance of driven EL elements which are connected to the intersections with the cathode line that has been selected for scanning and in order to prevent the EL elements connected to intersections between the driven anode lines and the cathode lines that have not been selected for scanning from emitting cross-talk light. This reverse bias voltage is generally set to a voltage approximately equal to the forward direction voltage (VF) of the EL element that is driven to emit light or to a voltage slightly lower than the above voltage. Since the scan switches SY1 to SYm are switched to the ground potential one after another for each horizontal scan period, the cathode scan line set to the ground potential functions as the scan line capable of making the EL elements connected to the cathode scan line emit light.

Based on image data brought from the light emission control section, a drive control signal (drive pulse) for controlling as to which timing and how long one of the EL elements connected to the anode drive line emits light is supplied to the anode line drive circuit 2. According to this drive control signal, the anode line drive circuit 2 controls so that some of the drive switches SX1 to SXn are turned on and works so as to supply drive current to the EL elements that correspond to image information through the anode drive lines A1 to An.

Thus, the EL elements to which the drive current is supplied are driven to emit light according to the image information. The state shown in FIG. 8 is a state in which a first cathode scan line B1 is scanned as described above, and since the drive switches SX1 and SX3 are in an ON state, the EL elements E11 and E31 are driven to emit light.

A reset operation of the reset circuit 4 is performed according to a reset control signal from the light emission control section. This operation is disclosed in, for example, Japanese Patent Application Laid-Open No. Hei 9-232074 and is performed in order to speed up the light emission start of the EL element driven to emit light corresponding to the next scan line when the scan line is switched. The organic EL element has a parasitic capacitance, and, for example, in the case where several tens of EL elements are connected to one anode drive line, a total capacitance of several tens times each parasitic capacitance is deemed to be connected with the anode drive line as a load capacitance.

Accordingly, at the head of the scan period, current from the anode drive line is consumed for charging the load capacitance, and a time delay occurs for charging until charge fully exceeds the light emission threshold voltage of an EL element, whereby a problem that light emission start of the EL element is delayed occurs after all. Specifically, in the case where the constant current sources I1 to In are employed as the drive sources as described above, since the constant current sources are high impedance output circuits on an operational principle, current is limited, and a delay of light emission start of an EL element occurs markedly. Thus, a discharging operation of electrical charge by the reset circuit 4 and an applying operation of the reverse bias voltage VM by the cathode scan circuit 2 function to give a voltage that momentarily exceeds the light emission threshold voltage fully to the anode terminal of an EL element which is driven to emit light in the next scan.

FIG. 9 shows a cathode reset operation by the reset circuit 4, and shows, for example, from the state in which the EL element E11 connected to the first anode drive line A1 is driven to emit light to the state in which the EL element E12 connected to the same first anode drive line A1 is driven to emit light in the next scan. In FIG. 9, the EL element which is driven to emit light is expressed as the symbol of a diode, and other is expressed by the symbol of a capacitor as a parasitic capacitance.

FIG. 9A shows a state before the cathode reset operation and shows the state in which the cathode scan line B1 is scanned, so that the EL element E11 is emitting light. Although the EL element E12 emits light in the next scan, before the EL element R12 emits light, the anode drive line A1 and all cathode scan lines B1 to Bm are reset to the ground potential as shown in FIG. 9B, so that all electric charge is discharged. Thus, the respective scan switches SY1 to SYm are connected to the ground side, and the reset switch SR1 is turned on. Then, in order to permit the EL element E12 to emit light, the cathode scan line B2 is scanned. That is, the cathode scan line B2 is connected to the ground, and the reverse bias voltage VM is applied to other cathode scan lines. At this time, the drive switch SX1 is turned on, and the reset switch SR1 is turned off.

Consequently, since electric charge of the parasitic capacitance in each element is discharged at the time of the reset described above, at that moment, as shown in FIG. 9C, charging in the reverse direction is performed by the reverse bias voltage VM as shown by arrows for the parasitic capacitance of elements other than the element E12 that emits light in the next. Charging current for these elements flows into the EL element E12 that emits light in the next via the anode drive line A1 to charge the parasitic capacitance of the EL element E12. At this time, the constant current source 11 connected to the drive line A1 is basically a high impedance output circuit as described above and thus does not influence the movement of the charging current.

In this case, on the assumption that, for example, 64 pieces of EL elements are arranged at the drive line A1 and that the reverse bias voltage VM is 10 (V), by the charging operation described above, the electrical potential V (A1) of the anode drive line A1 momentarily increases to an electrical potential based on Equation 1 shown below since the wiring impedance inside the panel is so small that it can be ignored. This operation is completed approximately in 1 μsec in a display panel having an outer shape of, for example, about 100 mm by 25 mm (256 times 64 dots).

$$V(\mathrm{A1})=(VM\times 63+0\mathrm{V}\times 1)/64=9.84\mathrm{V} \qquad \text{Equation 1}$$

Thereafter, the EL element E12 momentarily comes to be in a light emission state as shown in FIG. 9D by the drive current from the constant current source 11 flowing in the drive line A1. As described above, in the cathode reset method, utilizing the parasitic capacitance of the EL element which is originally an obstacle for driving and the reverse bias voltage for preventing the cross-talk light emission, the forward direction voltage of the EL element which is driven to emit light in the next is momentarily risen.

Now, in the case of utilizing the cathode reset method, the light emission start of the EL element can be made rapid, but operation for resetting charges stored in the parasitic capacitance of each EL element is accompanied for each cathode scanning, as shown in FIG. 9(*b*). For this reason, since the charges stored in each parasitic capacitance of each EL element are discharged by a driver IC via the cathode drive lines and the cathode scanning lines for each scan switching, power loss increases.

In other words, the discharge of the electric charge in each parasitic capacitance accompanied by the cathode reset operation is discarded as heat. Thus, in a display pattern in which a non-emission state in which each EL element does not emit light is caused to be continued according to image information based on image data, a considerable heat loss is generated.

Considering the electrical power consumed by the operation of the cathode reset described above, the following is explained. That is, from the relationship between the capacitor capacitance (C) and the voltage (V) applied thereto, the electrical power energy (Pd) can be expressed as $Pd=(1/2)\times CV^2$. Here, the parasitic capacitance of an EL element constituting one dot is about 4 pF. Where the VM is 10 (V) and the cathode line scan time is 170 μsec, in one dot of the non-emission state, the electrical power energy (W) consumed in one second can be expressed by the following Equation 2.

$$Pd=(1/2)\times 4\times 10^{-12}\times 10^{2}\times[1/(170\times 10^{-6})]=(2/170)\times(10^{-12\times 102})/\times(10^{-6})=(2/1.7)\times 10^{-6}=1.2(\mu W)\ldots \text{(rounded off to one decimal place)} \quad \text{Equation 2}$$

Accordingly, when the display panel, for example, of vertically and horizontally 64 by 256 dots is considered, an electrical power energy of 75 μW in one anode drive line, that is, in 64 dots, and of 19.3 mW in all dots is consumed in one second. This electrical power loss is consumed by the operation of the cathode reset, and since this becomes greater in proportion to the number of the EL elements inside the light emission display panel, the greater the display area, the greater the useless power loss.

In general, in consumer appliances, and the like making use of this type of display panel, in the state in which electrical equipment in which the display panel is arranged is not operating, only a display of the required minimum, for example, a display of time or the like, is performed, and other pixels are in the state of non-emission. However, since the cathode reset operation is performed from beginning to end for all the respective EL elements constituting the display panel as described above, the ratio of the power loss accompanied by the operation becomes enormously large.

For example, in the case where the display panel is employed in an electrical device employing commercial power supply or in an electrical device for being loaded in a vehicle, the power loss is overlooked. However, in the case where the display panel is employed in a portable device, an excessive battery consumption is caused. Consequently, in the case where the display panel is employed, for example, in a portable telephone, waiting time of the portable telephone has to be drastically shortened.

Thus, in a non-operation state of an electrical device, for example, in a waiting state of the portable telephone, in order to perform a display of minimum requirement, it is contemplated to execute a control so as to select a partial scan mode (hereafter, this is also referred to as partial scan) in which part of light-emitting elements in the display panel are repeatedly scanned to control light emission. In the case where such partial scan is employed, the power consumed here is reduced because the light-emitting elements other than those scanned partially naturally do not emit light.

Further, when the partial scan is employed, a means for scanning only part of the scan lines repeatedly can be used. Thus, it is not necessary to initially charge the scan lines other than those contributing to the display by executing the cathode reset operation, thereby a degree power loss caused by the cathode reset operation can be reduced.

Moreover, when the partial scan is employed, it is possible to increase a period of one scan by making a frame frequency constant and reducing the number of scanning operations. Accordingly, in the above passive matrix display panel, even if the drive current applied to the respective light-emitting elements is considerably reduced, the light emitting time of the elements is increased, which allows the luminance of light emitted from the display panel to be recognized substantially constant through human eyes. Thus, power consumption can be more reduced by reducing the drive currents applied to the respective light-emitting elements.

In the drive unit, where the cathode reset method can be employed as well as the partial scan can be selected, when the ordinary scan mode is switched to the partial scan mode, a means for lowering the frequency of the operation clocks used in a light emission control circuit in accordance with the number of scan lines used in the partial scan mode to the number of the effective scan lines constituting the display panel, that is, in accordance with the duty thereof.

FIGS. 10A and 10B show a relationship between a cathode reset period and a drive period (scan period) in the ordinary scan mode and the partial scan mode when an operation for lowering the frequency of the operation clocks used in the light emission control circuit is performed in accordance with the duty. FIGS. 10A and 10B show a case in which the duty in the partial scan mode is ¼. Then, FIGS. 10A and 10B show the specific numerical values of the respective periods (μsec) when the frame frequency is set to 100 Hz and the number of effective scan lines constituting the display panel is set to 64 lines.

As shown in FIG. 10A, when the ordinary scan mode (shown as ordinary display in FIG. 10A) is performed, one line period is 156 μsec, of which a cathode reset period R1 is 18 μsec and a drive period D1 is 138 μsec. Whereas when the partial scan mode (shown as partial display in FIG. 10B) is performed, one line period can be set to 156 μsec as shown in FIG. 10B, of which a cathode reset period R2 is 74 μsec and a drive period D2 is 551 μsec.

When the operation for simply lowering the frequency of the operation clocks used in the light emission control circuit is performed in accordance with the duty in the execution of the partial scan, the ratio between the cathode reset period and the drive period (R1:D1 and R2:D2) is made constant in either one of the ordinary scan mode and the partial scan mode. However, since the cathode reset operation can be completed momentarily as described already, the long period (74 μsec) as shown particularly as R2 in FIG. 10B is not always necessary.

Accordingly, when a minimum requisite cathode reset period is set also in the execution of the partial scan mode, the drive period can be set long accordingly. In other words, the light emitting time of the light-emitting elements can be increased even if the momentary luminance thereof is lowered by further reducing the drive currents supplied to the light-emitting elements, thereby it is possible to cause the luminance of light emitted from the display panel to be recognized substantially constant through human eyes. In addition to the above, since the momentary luminance of the respective light-emitting elements that emit light for display can be lowered, the deterioration of the light-emitting elements can be prevented so as to contribute to the extension of life of the luminescence display panel.

SUMMARY OF THE INVENTION

An object of the present invention, which was made based on the above technical point of view, is to provide a drive unit for a luminescence display panel capable of reducing power consumption when a partial scan mode is performed.

A drive unit for a luminescence display panel according to the present invention made to achieve the above object includes a plurality of drive lines and a plurality of scan lines intersecting each other, a plurality of capacitive light-emitting elements connected between the scan lines and the drive lines at a plurality of intersecting positions by the drive lines and the scan lines, scan mode switching means which capable of selecting a normal scan mode in which all effective light-emitting elements in the luminescence display panel are repeatedly scanned to control light emission and a partial scan mode in which part of the effective light-emitting elements in the luminescence display panel are repeatedly scanned to control light emission, and one of reset control means for resetting all of the plurality of scan lines to the same electrical potential each time the respective scan lines are switched and reset control means for resetting all of the plurality of scan lines and at least drive lines that are driven next for light emission to the same electrical potential. In the above arrangement, the drive unit for the luminescence display panel is characterized in that when the partial scan mode is selected by the scan mode switching mean, a control is performed so that the ratio of a drive period, during which the light emission of the light-emitting elements is controlled, to a reset period set by the reset control means is increased as compared with a case in which the ordinary scan mode is selected.

In this case, in a preferable embodiment, when the partial scan mode is selected by the scan mode switching means, a reset period that is approximately the same as that when the ordinary scan mode is selected may be set.

As a means for setting the approximately same reset period, an arrangement may be preferably employed in which a management is performed so that the number of counted-up operation clocks for setting the drive period is increased in accordance with the ratio of the drive period to the reset period as compared with the case in which the ordinary scan mode is selected.

As another means for setting the approximately same reset period, an arrangement may be employed in which operation clocks having a different cycle are used to set the reset period and the drive period, and when the partial scan mode is selected by the scan mode switching means, the operation clocks for setting the drive period has a cycle larger than that of the operation clocks used when the ordinary scan mode is selected.

In this case, it is preferable that the number of counted-up operation clocks for setting the drive period when the partial scan mode is selected by the scan mode switching means be managed so that it is made approximately the same as the number of counted-up operation clocks for setting the drive period when the ordinary scan mode is selected thereby.

In contrast, the number of counted-up operation clocks for setting the reset period when the partial scan mode is selected by the scan mode switching means may be managed so that it is made approximately the same as the number of counted-up operation clocks for setting the reset period when the ordinary scan mode is selected thereby.

In addition to the above, it is preferable that the drive unit for the luminescence display panel include a luminance variable means for lowering the momentary luminance of the light-emitting element when the partial scan mode is selected by the scan mode switching means as compared with the momentary luminance when the ordinary scan mode is selected thereby.

In a preferable embodiment of this case, the luminance variable means may change the drive currents applied to the respective drive lines. Further, the luminance variable means may change the drive voltages applied to the respective drive lines. Furthermore, the respective arrangements described above may be preferably utilized by a drive unit for a luminescence display panel in which organic electro-luminescence elements are used as the light-emitting elements.

According to the drive unit arranged as described above, the normal scan mode in which all effective light-emitting elements in the luminescence display panel are repeatedly scanned and the partial scan mode in which part of the effective light-emitting elements in the luminescence display panel are repeatedly scanned are selected. When the partial scan mode is selected, the control is performed so that the ratio of the drive period, during which the light emission of the light-emitting elements is controlled, to the reset period set by the reset control means is increased as compared with the case in which the ordinary scan mode is selected.

Thus, in the partial scan mode, the drive period occupied in one line period can be more increased. Accordingly, even if the momentary luminance of the light-emitting elements is lowered by further reducing the drive currents or drive voltages supplied to the respective light-emitting elements, human eyes do not feel that the luminance of light emitted by the display panel is substantially lowered because the light emission time of the elements can be increased, and the human eyes can recognize that the luminance of the emitted light is approximately constant. As a result, it is possible to further reduce the power consumption of the luminescence display panel by reducing the drive currents or drive voltages supplied to the respective light-emitting elements.

In addition to the above, the momentary luminance of the respective light-emitting elements that emit light for display can be lowered, which contributes to prevent the deterioration of the light-emitting elements and to increase the period during which the luminescence display panel can maintain predetermined luminance of emitted light, that is, to extend the life the display panel.

BRIEF DESCRIPTION OF THE DRAWINGS

FIG. 1 is a wiring diagram showing a fundamental structure of a drive unit for a display panel according to the present invention;

FIG. 2 is a block diagram showing a structural example of a light emission control section in the drive unit shown in FIG. 1;

FIG. 3 is a schematic view showing a scan operation example by the drive unit according to the present invention;

FIGS. 4A and 4B are timing charts showing relationships between scan periods and reset periods of the case where a scan mode is switched;

FIGS. 5A to 5C are timing charts showing a control method including operation clocks when the scan periods and the reset periods shown in FIGS. 4A and 4B are set;

FIG. 6 is a view showing an equivalent circuit of an organic EL element;

FIGS. 7A, 7B, and 7C are graphs showing various characteristics of the organic EL element;

FIG. 8 is a wiring diagram showing a fundamental structure of a conventional drive unit for a display panel;

FIGS. 9A, 9B, 9C, and 9D are views showing equivalent circuits explaining a cathode reset operation; and FIGS. 10A and 10B are views showing relationships between a scan period and a reset period in the conventional drive unit when a scan mode is switched.

DESCRIPTION OF THE PREFERRED EMBODIMENTS

An embodiment of a drive unit for a luminescence display panel according to the present invention is explained below with reference to drawings. In this embodiment, an organic EL element is employed as a light-emitting element, and a cathode line scan/anode line drive feature similar to the one explained using FIG. 8 is employed in the embodiment shown in FIG. 1. That is, in a display panel 1, "n" pieces of anode lines A1 to An are arranged as drive lines in a vertical direction, "m" pieces of cathode lines B1 to Bm are arranged as scan lines in a horizontal direction, and organic EL elements E11 to Enm are arranged at portions at which each line intersects (n×m portions in total).

The respective elements E11 to Enm constituting pixels are arranged in the form of a lattice, and anode terminals of the EL elements are connected to the anode lines A1 to An and the cathode terminals of the EL elements are connected to the cathode lines B1 to Bm, corresponding to intersecting positions between the anode lines A1 to An along the vertical direction and the cathode lines B1 to Bm along the horizontal direction. The respective anode lines are connected to an anode line drive circuit 2 and a reset circuit 4, and the respective cathode lines are connected to a cathode line scan circuit 3, so that the respective lines drive the EL elements E11 to Enm to emit light.

The cathode line scan circuit 3 is provided with scan switches SY1 to SYm corresponding to the respective cathode scan lines B1 to Bm to work so that either one of a reverse bias voltage VM from a reverse bias power supply circuit 5 (for example, 10 V) and the ground potential (0 V) is connected to a corresponding cathode scan line. The anode line drive circuit 2 is provided with drive sources I1 to In supplying drive currents to the respective EL elements via the respective anode lines and drive switches SX1 to SXn, and the drive switches are controlled to be turned on so that currents from the drive sources I1 to In are supplied to the respective EL elements arranged corresponding to the cathode scan lines.

In this embodiment, a variable voltage source 10 is disposed in the anode line drive circuit 2, and based on the voltage output from this variable voltage source 10, the current values from constant current sources I1 to In constituting the above drive sources can be controlled. Thus, when the respective light-emitting elements are caused to selectively emit light by connecting the constant current sources I1 to In to desired anode drive lines while the cathode scan lines are scanned at a predetermined cycle, the instant luminance of the light-emitting elements can be controlled.

The respective anode drive lines are further connected to the reset circuit 4. This reset circuit 4 is provided with respective reset switches SR1 to SRn provided for the respective anode drive lines, and these reset switches are turned on so that the anode drive lines are set to the ground potential. Each of the anode line drive circuit 2, the variable voltage source 10 disposed in this anode line drive circuit 2, the cathode lines can circuit 3, and the reset circuit 4 is driven by command signals brought from a light emission control section 11 constituting a light emission control means. The lighting operation of the display panel 1 and the cathode reset operation are already explained with reference to FIGS. 8 and 9.

FIG. 2 shows a detailed structure of the light emission control section 11 shown in FIG. 1 as a block diagram. An image signal supplied from an image signal generation system which is not shown is sent to the light emission control section 11. The image signal is supplied to a sync separator circuit 15, and the sync separator circuit 15 extracts horizontal and vertical sync signals from the supplied input image signal and sends these sync signals to a timing pulse generation circuit 16. The timing pulse generation circuit 16 generates a sync signal timing pulse based on the extracted horizontal and vertical sync signals, and sends the timing pulse to each of an A/D (Analog-to-Digital) converter 17, a control circuit 18, and a scan timing signal generation circuit 19.

The A/D converter 17 converts the input image signal to digital pixel data corresponding to one pixel in synchronism with the timing pulse brought from the timing pulse generation circuit 16, and sends the pixel data to a memory 20 composed of a RAM. This memory 20 at least has a storage area of image data of one screen (one frame) of the luminescence display panel 11.

The control circuit 18 sends a write-signal and a read-signal synchronous with the timing pulse brought from the timing pulse generation circuit 16 to the memory 20. The memory 20 sequentially incorporates individual pieces of pixel data supplied from the A/D converter 17 in accordance with the write-signal. In accordance with the read-signal, the memory 20 sequentially reads the pixel data stored in the memory 20 and sends the data to an output processing circuit 21 of the next section.

The scan timing signal generation circuit 19 generates timing signals to control the scan switches SY1 to SYm in the cathode line scan circuit 3 based on the timing pulse brought from the timing pulse generation circuit 16. Thus, a scans election control signal is supplied from the scan timing signal generation circuit 19 to the cathode line scan circuit 3. Further, the timing signal is supplied from the scan timing signal generation circuit 19 to the output processing circuit 21, and the output processing circuit 21 supplies a drive control signal in accordance with the pixel data supplied from the memory 20 to the anode line drive circuit 2 in synchronism with the timing signal. Thus, a drive current based on the image data is selectively supplied to the anode line in synchronism with the cathode line scan, and an image based on the image signal is reproduced in the luminescence display panel 1.

The control circuit 18 supplies a reset signal to the reset circuit 4 via the output processing circuit 21 during a cathode reset period and supplies the same reset signal to the cathode line scan circuit 3 via the scan timing signal generation circuit 19. Thus, the cathode line reset operation explained with reference to FIG. 9 is performed.

In this embodiment, a control signal is supplied from a scan mode alteration circuit 13 constituting a scan mode alteration means to the light emission control section 11. This scan mode alteration circuit 13 functions so as to select a normal scan mode in which all effective light-emitting elements in the luminescence display panel 1 are repeatedly scanned to control light emission and a partial scan mode (partial scan) in which part of the effective light-emitting elements in the luminescence display panel 1 are repeatedly scanned to control light emission. Accordingly, for example, in some cases this scan mode alteration circuit 13 sends a switching command signal to the light emission control section 11 by a manual operation, and in other cases it sends the switching command signal to the light emission control section 11 automatically.

For example, in the case where the present invention is employed in a portable telephone, switching can be performed automatically so that the partial scan mode is selected in awaiting state of the telephone and the normal scan mode is selected in a telephone talking state. In this case, the scan mode alteration circuit 13 constitutes part of a transmitting/receiving circuit of the telephone or is constituted so that a signal showing the telephone talking state or a non-talking state from the transmitting/receiving circuit is supplied to the circuit 13, and based on the above constitution, the circuit 13 sends the switching command signal to the light emission control section 11.

As shown in FIG. 2, the scan mode alteration circuit 13 is constituted so that the switching command signal is sent to the timing pulse generation circuit 16 and the control circuit 18 that constitute the light emission control section 11. Here, when the switching is performed, for example, from the normal scan mode to the partial scan mode, or, conversely, from the partial scan mode to the normal scan mode, the switching command 24 signal is sent from the scan mode alteration circuit 13 to the timing pulse generation circuit 16, and based on this signal, the timing pulse generation circuit 16 counts up operation clocks used here as described above and changes the cycle of the timing pulse depending upon the number of the counted-up operation clocks.

The control circuit 18 receiving the switching command signal sent from the scan mode alteration circuit 13 sends a control signal determining the area of the cathode line scan to the scan timing signal generation circuit 19. Further, the control circuit 18 operates so as to change the cycle of write and read operations for the memory 20 and sends a control signal for changing the output voltage of the variable voltage source 10 in the anode line drive circuit 2.

Here, in an example of the case where, for example, switching is performed from the normal scan mode to the partial scan mode, the concept of the display feature of the display panel of this case areas shown in FIG. 3. That is, in the partial scan mode, as shown in FIG. 3, for example, first to "k"th cathode lines in a total scan line "m" (the number of the cathodes lines) formed in the display panel 1 are scanned, proceeding to the next one frame scan without scanning the respective cathode lines of "k+1"th to "m"th. That is, in the partial scan mode, only the cathodes lines from first to "k"th are repeatedly scanned.

FIGS. 4A and 4B show a relationship between the cathode reset period and a drive period during one line period performed at the time. FIG. 4A shows a relationship between a cathode reset period R1 and a drive period D1 during the one line period in an ordinary scan mode (ordinary display), and the relationship is similar to that shown in FIG. 10A explained already. In contrast, in a partial display mode (partial display) in this embodiment, the cathode reset period R1 is set similarly to the cathode reset period R1 in the ordinary scan mode shown in FIG. 4A, and the remaining period in the one line period is set as a drive period D3.

That is, in the partial display in which the above duty is set to ¼, the one line period can be set to 625 μsec. Thus, the period of 607 μsec obtained by subtracting the cathode reset period R1 from the one line period is set as a drive period D3. Accordingly, the drive period D3 can be set longer than the drive period D2 shown in FIG. 10B, thereby it is possible to substantially extend the light emission time of the EL elements driven in the partial display.

In other words, the drive currents supplied to the EL elements that emit light for display can be reduced, which results in the reduction of power consumption of the display panel 1. Further, since the drive currents supplied to the respective EL elements can be controlled to be made smaller, stress applied to the respective EL elements can be reduced, which contributes also to extend the life of the display panel.

FIGS. 5A to 5C show examples of control methods for controlling the ordinary display shown in FIG. 4A and the partial display shown in FIG. 4B when they are performed. That is, in FIG. 5A, operation clocks having a predetermined cycle (width) are used to set the reset period R1 and the drive period D1 of the one line period in which the ordinary display is performed. The operation pulses are used by the timing pulse generation circuit 16 in FIG. 2. The timing pulse generation circuit 16 sets the reset period R1 (18 μsec) by counting up a pieces of clocks and sets the drive period D1 (138 μsec) by counting up b pieces of clocks. Therefore, the cathode scan executed in the ordinary display is performed by repeating the above operation.

In contrast, FIG. 5B shows a first example of the control method of controlling the partial display. According to the first example, when the reset period R1 and the drive period D3 are set in the one line period, operation clocks having a predetermined cycle (width) are used similarly to the case of FIG. 5A. The operation pulses are used by the timing pulse generation circuit 16 in FIG. 2. The timing pulse generation circuit 16 sets the reset period R1 (18 μsec) by counting up a pieces of clocks first and sets the drive period D3 (607 μsec) by counting up c pieces of clocks next. Accordingly, the cathode scan is repeatedly performed in the region where the partial display is executed by repeating the above operation.

In other words, when the partial scan mode is selected, the control is performed so that the number of counted-up of operation clocks for setting the drive period is increased in accordance with the ratio of the drive period to the reset period as compared with the case in which the ordinary scan mode is selected.

Therefore, when the first example of the control method of controlling the partial display (1) is employed, a counter for setting the drive period D3 is also necessary in addition to a counter for setting the reset period R1 and a counter for setting the drive period D1 that are used in the ordinary display. However, one kind of operation clocks can be used as the operation clocks to be counted up.

FIG. 5C shows a second example of the control method of controlling the partial display. According to the second example, when the reset period R1 and the drive period D3 are set in the one line period, operation clocks having a different cycle are used, respectively. That is, when the reset period R1 is set, operation clocks having the same cycle as that shown in FIGS. 5A and 5B are used. In contrast, operation clocks obtained by quartering the operation clocks used to set the reset period R1 are used to set the drive period D3.

That is, the drive period D3 in the partial display (2) can be set by counting up the quartered clocks and utilizing the counter for setting the drive period D1 in the ordinary display described above as it is. In other words, the end of the drive period D3 can be determined by counting up b pieces of operation clocks in this case. Therefore, according to this constitution, the drive period D3 can be set without providing the different counter for counting up the number of clocks c for setting the drive period D3 as in the case in which the control method of the partial display (1) is employed.

Further, in a passive matrix display device of this embodiment, when the partial display is selected and the one line period is increased, the light emission time of the display elements is increased, thereby the luminance of a display screen is substantially increased. In addition to the above, since the control is performed so that the ratio of the drive period is increased in the one line period in this embodiment, the luminance of the display screen is substantially further increased. Accordingly, there is provided a current variable means (luminance variable means) to reduce the drive currents supplied to the respective EL elements in accordance with the ratio of increase of the drive period when the partial display is selected.

That is, in FIG. 2, when the control circuit 18 receives a signal showing that the partial display has been selected from the scan mode alteration circuit 13, the control circuit 18 sends a control signal to the variable voltage source 10 (shown in FIG. 1) in the anode line drive circuit 2 and reduces the output currents from the respective drives sources I1 to In acting as constant current sources. That is, since the currents flowing in the EL elements are approximately proportional to the luminance of emitted light in the relationship therebetween as described above, the partial display can be driven with the luminance of emitted light that is substantially similar to the case in which the ordinary scan mode is selected by reducing the drive currents. In this case, the control is performed so as to further reduce the drive currents in correspondence to the increase in ratio of the drive period in the one line period as described above.

Thus, when the partial scan mode is selected, the drive currents applied to the EL elements are reduced in correspondence to the increase in the one line period and further to the increase in the ratio of the drive period in the one line period, in addition to the increase in the one line period, thereby the power consumption can be further reduced when the partial scan mode is selected. The constant currents are supplied to the respective EL elements from the respective drive sources I1 to In in this embodiment. However, even if constant voltage sources, for example, are used as the drive sources, power consumption can be further reduced likewise by controlling the constant voltage sources so as to reduce the voltages output therefrom.

Note that respective parameters are constructed in the control circuit 18 in the form of tables in correspondence to the case of the ordinary scan mode and to the case of several selectable partial scan modes, and the parameters include the data of a cathode line scan region, the reset periods and the drive period in the respective cases as well as control data to be supplied to the variable voltage source 10, and the like. Therefore, when a command for switching to the partial scan mode is received from the scan mode alteration circuit 13, the respective parameters can be momentarily obtained by referring to a table corresponding to the command. These parameters can be obtained similarly in any of the cases in which the ordinary scan mode is switched to a partial scan mode, the partial scan mode is switched to the ordinary scan mode, and further the partial scan mode is switched to another partial scan mode.

In the embodiment explained above, the reset periods set in the ordinary display and the partial display are the same period (R1=18 $\mu$sec) together as shown in, for example, FIG. 4. However, the present invention is not limited to the particular embodiment. For example, when the partial scan mode is selected, the currents or the voltages supplied to the respective elements can be reduced by increasing the ratio of the drive period to the reset period as compared with the case in which the ordinary scan mode is selected, thereby the power consumption of the elements can be reduced.

As apparent from the above explanation, according to the drive unit for the luminescence display panel of the present invention, the control is performed so that the ratio of the drive period to the reset period is increased as compared with the case in which the ordinary scan mode is selected, thereby the momentary luminance of the light-emitting elements can be lowered by further reducing the drive currents or drive voltages supplied to the respective light-emitting elements. Accordingly, the power consumption of the luminescence display panel can be further reduced by the reduction of the drive currents or drive voltages supplied to the respective light-emitting elements. In addition to the above, the momentary luminance of the respective light-emitting elements that emit light for display can be lowered, which contributes to prevent the deterioration of the light-emitting elements and to increase the period during which the luminescence display panel can maintain predetermined luminance of emitted light, that is, to extend the life of the display panel.

What is claimed is:

1. A drive unit for a luminescence display panel comprising:

a plurality of drive lines and a plurality of scan lines intersecting each other;

a plurality of capacitive light-emitting elements connected between the scan lines and the drive lines at a plurality of intersecting positions by the drive lines and the scan lines;

scan mode switching means which capable of selecting a normal scan mode in which all effective light-emitting elements in the luminescence display panel are repeatedly scanned to control light emission and a partial scan mode in which part of the effective light-emitting elements in the luminescence display panel are repeatedly scanned to control light emission; and one of reset control means for resetting all of the plurality of scan lines to the same electrical potential each time the respective scan lines are switched and reset control means for resetting all of the plurality of scan lines and at least drive lines that are driven next for light emission to the same electrical potential, wherein when the partial scan mode is selected by the scan mode switching mean, a control is performed so that the ratio of a drive period, during which the light emission of the light-emitting elements is controlled, to a reset period set by the reset control means is increased as compared with a case in which the ordinary scan mode is selected.

2. A drive unit for a luminescence display panel according to claim 1, wherein when the partial scan mode is selected by the scan mode switching means, a reset period that is approximately the same as that when the ordinary scan mode is selected is set.

3. A drive unit for a luminescence display panel according to claim 1 or 2, wherein operation clocks having the same cycle are used to set the reset period and the drive period, and when the partial scan mode is selected by the scan mode switching means, a management is performed so that the number of counted-up operation clocks for setting the drive period is increased in accordance with the ratio of the drive period to the reset period as compared with the case in which the ordinary scan mode is selected.

4. A drive unit for a luminescence display panel according to claim 1 or 2, wherein operation clocks having a different cycle are used to set the reset period and the drive period, and when the partial scan mode is selected by the scan mode switching means, the operation clocks for setting the drive period has a cycle larger than that of the operation clocks used when the ordinary scan mode is selected.

5. A drive unit for a luminescence display panel according to claim 4, wherein the number of counted-up operation clocks for setting the drive period when the partial scan mode is selected by the scan mode switching means is made approximately the same as the number of counted-up operation clocks for setting the drive period when the ordinary scan mode is selected thereby.

6. A drive unit for a luminescence display panel according to claim 3, wherein the number of counted-up operation clocks for setting the reset period when the partial scan mode is selected by the scan mode switching means is made approximately the same as the number of counted-up operation clocks for setting the reset period when the ordinary scan mode is selected thereby.

7. A drive unit for a luminescence display panel according to claim 4, wherein the number of counted-up operation clocks for setting the reset period when the partial scan mode is selected by the scan mode switching means is made approximately the same as the number of counted-up operation clocks for setting the reset period when the ordinary scan mode is selected thereby.

8. A drive unit for a luminescence display panel according to claim 1 or 2, comprising luminance variable means for lowering the momentary luminance of the light-emitting element when the partial scan mode is selected by the scan mode switching means as compared with the momentary luminance when the ordinary scan mode is selected thereby.

9. A drive unit for a luminescence display panel according to claim 8, wherein the luminance variable means changes the drive currents applied to the respective drive lines.

10. A drive unit for a luminescence display panel according to claim 8, wherein the luminance variable means changes the drive voltages applied to the respective drive lines.

11. A drive unit for a luminescence display panel according to claim 1 or 2, wherein the light-emitting elements comprise organic electroluminescence elements.

* * * * *